US010759592B2

(12) United States Patent
Anderson

(10) Patent No.: US 10,759,592 B2
(45) Date of Patent: Sep. 1, 2020

(54) LIGHT EMITTING DIODE (LED) LIGHT BULB PACKAGING

(71) Applicant: Deloren E. Anderson, Crosslake, MN (US)

(72) Inventor: Deloren E. Anderson, Crosslake, MN (US)

( * ) Notice: Subject to any disclaimer, the term of this patent is extended or adjusted under 35 U.S.C. 154(b) by 569 days.

(21) Appl. No.: 15/207,293

(22) Filed: Jul. 11, 2016

(65) Prior Publication Data

US 2017/0362018 A1 Dec. 21, 2017

Related U.S. Application Data

(60) Provisional application No. 62/352,887, filed on Jun. 21, 2016.

(51) Int. Cl.

| | |
|---|---|
| ***B65D 85/42*** | (2006.01) |
| ***B65B 31/00*** | (2006.01) |
| ***B65B 23/22*** | (2006.01) |
| ***B65D 77/02*** | (2006.01) |
| ***B65D 75/02*** | (2006.01) |
| ***B65D 81/20*** | (2006.01) |
| ***B65D 75/00*** | (2006.01) |
| ***B65D 59/04*** | (2006.01) |

(52) U.S. Cl.

CPC ..... *B65D 85/42* (2013.01); *B65B 23/22* (2013.01); *B65B 31/00* (2013.01); *B65D 59/04* (2013.01); *B65D 75/002* (2013.01); *B65D 75/02* (2013.01); *B65D 77/02* (2013.01); *B65D 81/203* (2013.01)

(58) Field of Classification Search

CPC ..... B65D 85/42; B65D 77/02; B65B 23/22; B65B 31/00

USPC ..... 206/418, 420

See application file for complete search history.

(56) References Cited

U.S. PATENT DOCUMENTS

| | | | | |
|---|---|---|---|---|
| 2,443,810 A * | 6/1948 | White | B65D 5/5069 | 206/422 |
| 6,016,919 A * | 1/2000 | Smith | B65D 5/606 | 206/418 |
| 2012/0033440 A1* | 2/2012 | Wheelock | F21V 31/04 | 362/555 |
| 2012/0075854 A1* | 3/2012 | Maxik | F21K 9/90 | 362/235 |

* cited by examiner

*Primary Examiner* — King M Chu

(74) *Attorney, Agent, or Firm* — Schwegman Lundberg & Woessner, P.A.

(57) ABSTRACT

A method includes obtaining a container sized to fit multiple high voltage light emitting diode (LED) lightbulbs, adding multiple loose high voltage LED lightbulbs to the container to fill the container, and sealing the container, such that the container contains a higher density of high voltage LED light bulbs than a same sized container can hold protective packaged equivalent watt incandescent bulbs.

12 Claims, 15 Drawing Sheets

LIGHT EMITTING DIODE (LED) LIGHT BULB PACKAGING

RELATED APPLICATION

This application claims priority to U.S. Provisional Application Ser. No. 62/352,887 (entitled Light Emitting Diode (LED) Light Bulb Packaging, filed Jun. 21, 2016) which is incorporated herein by reference.

BACKGROUND

Light bulbs have been manufactured in remote locations and shipped to distribution centers and retail stores for many years. Such light bulbs are generally packaged in a material that protects the bulb from damage, and at the same time, adds significant volume, cutting down the number of light bulbs that can be fit into a shipping container.

Some bulbs are encased in a rigid plastic which extends significantly in one or more directions beyond the shape of the bulb itself. Other bulbs may be packaged in cardboard, which may be corrugated, but generally has a three dimensional rectangular or cube shape. Since the bulbs are generally rounded, the packaging adds significant volume to the bulb, resulting in fewer bulbs that may be fit into a box or other container for efficient shipping. This can increase shipping costs significantly, as many shipping rates are based on the size of a container being shipped, such as standard shipping containers utilized on container based ships.

When the bulbs finally reach a retail outlet, individual bulbs with packaging, or multiple bulbs per package may be put on shelves or hung from hooks in the case of plastic packaging. Such packaging continues to contribute excess volume, resulting in less product being made available for purchase by the final consumer.

SUMMARY

A light emitting diode (LED) light bulb includes a dome, a base coupled to the dome, an Edison style connector coupled to the base, and a protective sleeve disposed about the Edison style connector, the protective sleeve configured to protect comes of adjacent LED light bulbs from being marked by the Edison style connector.

Light emitting diode (LED) based lightbulbs may be constructed of plastic, and packaged loosely in a carton to optimize lightbulb density in the carton. In some embodiments, the LED based lightbulbs may be enclosed in a plastic bag with printing. The printing may include codes to facilitate purchase and may also describe the lightbulbs to consumers to aid in purchasing.

In some embodiments, the size of the carton may be optimized to fit a desired number of bulbs with minimal wasted space. In one embodiment, cartons may be reduced or increased in height to minimize wasted space at the top of the carton. Many cartons may be combined together to form pallets of bulbs, and further combined to fit into standard shipping containers.

A method includes covering multiple high voltage light emitting diode (LED) lightbulbs having Edison connectors with a protective sleeve that extends at least to an end of each connector, placing the connector covered multiple high voltage light emitting diode (LED) lightbulbs into a conformable polymer container having a hole, adding multiple loose high lumen LED lightbulbs to the container to fill the container, and removing air from the container via the hole such that the loose high voltage LED lightbulbs nest with each other in direct contact with each other such that the container contains a higher density of high lumen LED light bulbs than a same sized container can hold protective packaged equivalent watt incandescent bulbs.

A method includes obtaining a container sized to fit multiple high voltage light emitting diode (LED) lightbulbs having Edison connectors, covering each lightbulb connector with a protective sleeve that extends at least to an end of each connector, adding multiple loose high voltage LED lightbulbs to the container to fill the container with the loose high voltage LED lightbulbs nesting with each other, and sealing the container, such that the container contains a higher density of high voltage LED light bulbs than a same sized container can hold protective packaged equivalent watt incandescent bulbs.

A container includes six rectangular sides coupled to form a box with one of the sides forming a cover of the box, a plurality of loose high voltage light emitting diode (LED) lightbulbs disposed within the box, wherein each lightbulb includes a protective sleeve disposed over a connector portion of each lightbulb to prevent marking of other lightbulbs by the connector of any one bulb, wherein the box is sealed by the cover, such that the box contains a higher density of high voltage LED light bulbs than a same sized box can hold protective packaged equivalent watt incandescent bulbs.

A method includes covering multiple high voltage light emitting diode (LED) lightbulbs having Edison connectors with a protective sleeve that extends at least to an end of each connector and placing the connector covered multiple high voltage light emitting diode (LED) lightbulbs into a container such that the loose high voltage LED lightbulbs nest with each other in direct contact with each other such that the container contains a higher density of high lumen LED light bulbs than a same sized container can hold protective packaged equivalent lumen incandescent bulbs.

DETAILED DESCRIPTION

In the following description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that structural, logical and electrical changes may be made without departing from the scope of the present invention. The following description of example embodiments is, therefore, not to be taken in a limited sense, and the scope of the present invention is defined by the appended claims.

Figure 1:
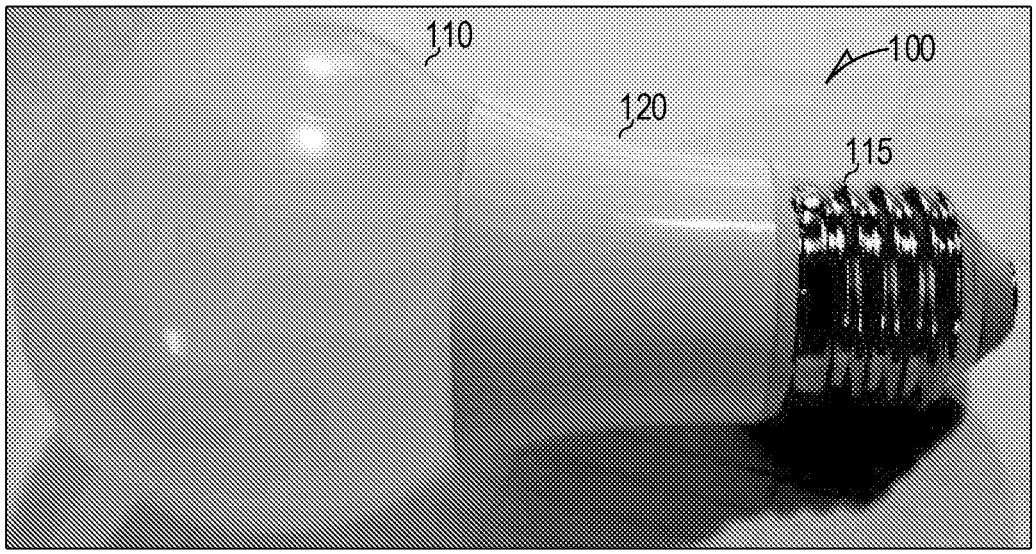
FIG. 1 is a representation of an LED lightbulb according to an example embodiment.

High voltage light emitting diode (LED) based lightbulbs, one of which is indicated in FIG. 1, may be packaged loosely in a container, such as a box, bag, or carton to optimize lightbulb density in the container. This is contrasted with common high voltage incandescent lightbulbs, which generally had relative large and fragile glass domes and delicate filaments, which required protection to avoid damage during shipping. The protection was provided in the form of volume inefficient packaging.

The LED lightbulbs, an example of which is shown in FIG. 1 at 100, in one embodiment have plastic domes 110, an Edison base 115, and a light source within a base 120, such as one or more LEDs. The dome 110 and light source are significantly more robust than the components of prior incandescent bulbs. Yet for some reason, the packaging of LED lightbulbs has remained consistent with the volume inefficient packaging of the prior incandescent bulbs.

In some embodiments, the LED based lightbulbs may be enclosed in a container which is a plastic bag with printing. The printing may include codes to facilitate purchase and may also describe the lightbulbs to consumers to aid in purchasing.

The bag may be formed of a conformable polymer material, such as plastic, that allows nesting of the lightbulbs where more than one lightbulb is placed in the container. The bag may also have a hole formed in it to provide a mechanism for hanging the bag for display at a retail store, such as a post or rod. The hole may serve the additional purpose of providing a passage for air to move out of the bag, allowing unrestricted nesting of the bulbs in the bag, as well as nesting of multiple bags when packaged together in a box. Nesting means that the bulbs are contacting each other and result in a high density of bulbs per volume by naturally moving with respect to each other to fill available space. Domes may nest near bases of adjacent bulbs for example such that multiple bulbs take up less volume when nested.

In some embodiments, high voltage LED lightbulbs may be placed in a container which is a box or carton, with or without the use of a bag. The size of a box or carton, which may be formed of six rectangles of cardboard or corrugated cardboard, wood, or plastic, and assembled into a box-like structure, may be optimized to fit a desired number of bulbs with minimal wasted space. One of the rectangles may be formed in the shape of a cover or multiple folding pieces coupled to sides of the box to fold to form a top side or cover. Rectangles in one embodiment may include squares. In one embodiment, cartons may be reduced or increased in height to minimize wasted space at the top of the carton. Many cartons may be combined together to form pallets of bulbs, and further combined to fit into standard shipping containers.

In one example embodiment, the LED lightbulb has an A-19 form factor. The most commonly used A-series light bulb type is the A19 bulb (or its metric equivalent, the A60 bulb), which is 2 and ⅜ inches (60 mm) wide at its widest point and approximately 4 and ⅜ inches (110 mm) in length, and has a one-inch long (type E26, i.e. 26 millimeters in diameter) Edison screw base.

In further embodiments, many different incandescent equivalent wattages, referred to as high voltage bulbs may be used. Some example equivalent wattages that are equated to lumens may include 25 watt-350 lumen, 40 watt-450 lumen, 60 watt-800 lumen, 75 watt-1050 lumen, 100 watt-1600 lumen, 100+ watt bulbs, flood lights, down lights, and tube replacement, 100 volt-285 volt, and other all high voltage lights.

High voltage LED lightbulbs are defined as those bulbs that correspond to an equivalent 50 volt or higher voltage incandescent bulb, as defined by the National Electric Code. Another characteristic of such LED lightbulbs is that their counterpart incandescent bulbs generally contain high surface area domes that are made of glass, and are fairly breakable, in addition to containing delicate filaments that produce the light. The high voltage LED lightbulbs are contrasted in that they have domes made of plastic, and LED light sources that are not as fragile as the incandescent domes and filaments. Example high voltage LED lightbulbs may be dropped several feet onto a hard surface and not be damaged, whereas a typical incandescent bulb would likely have a shattered dome and broken filament from the same drop.

LED lightbulb 100 includes an Edison base 115, but may also have a pin base, bayonet twist type base or otherwise adapted for individual or track mounting in many different lighting sources. A-19 LED lightbulbs for example, may be packaged in volumes of 1, 2, or more in plastic bags. The packaging of two or more bulbs in a plastic bag may be slightly cheaper that packaging one per bag, as the additional material cost to do so is nominal. Equivalent incandescent bulb domes that are made of glass may be susceptible to damage by the metal base of other bulbs, breaking by domes bumping into each other, or even just from domes being pressed together, which is one reason they are routinely protectively packaged.

Figure 2:
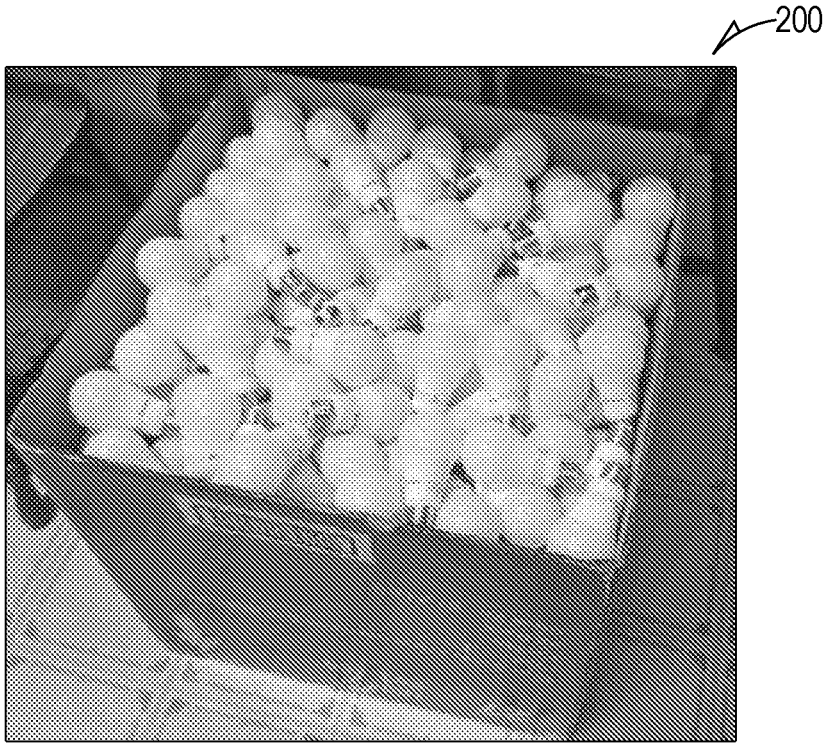
FIG. 2 is a representation of carton of LED lightbulbs according to an example embodiment.

When LED lightbulbs are packaged in boxes or cartons as shown generally at 200 in FIG. 2, an A-19 equivalent size bulb may be packaged 256 bulbs/box, with 32 boxes/pallet, and 22 pallets per standard shipping container. Note that FIG. 2 is also representative of the number of bulbs that may be placed in a container where the bulbs contain sleeves that cover the connector and protect domes of other bulbs from becoming marked by the connectors of adjacent bulbs. That comes out to 180,224 bulbs per container for a doubling of the number of bulbs per standard shipping container as compared to bulbs with protective packaging.

In one embodiment, one or more bulbs may be placed in bags, such as a bag labeled for retail. The bulbs, such as two, three, four, or more may be placed into bags without the need for individual bulb protective packaging material. The lack of packaging material facilitates nesting of the bulbs within each bag that contains multiple bulbs, and further may facilitate nesting of multiple bags of bulbs placed into boxes.

In one embodiment, doubling the number of A-19 size bulbs in the same space, may be accomplished by changing the size of the boxes to be more efficient than simply cutting existing boxes in half. The bulbs being placed in the box may be completely loose or bagged with one or more bulbs per bag. If the half box is increased in size by 12.5%, 12.5% of the number of boxes may be eliminated. The bulbs fit more efficiently in such a box because of increased nesting surface. In one example, an original four boxes stacked, cut in half result in 8 boxes half the size of the original boxes. However, such half boxes may not hold as much as 7 boxes stacked that are 12.5% taller which will result in more nesting area per box and less open space at the top of the box. Finding an optimally sized box for different size bulbs may be done by counting the number of bulbs that fit in various sized boxes and comparing the number to the volume of each box. In further embodiments, a full box that cannot contain additional bulbs may be observed to determine the amount of dead space at the top of the box, and then reducing the height of the box an amount corresponding to the dead space.

Figure 3:
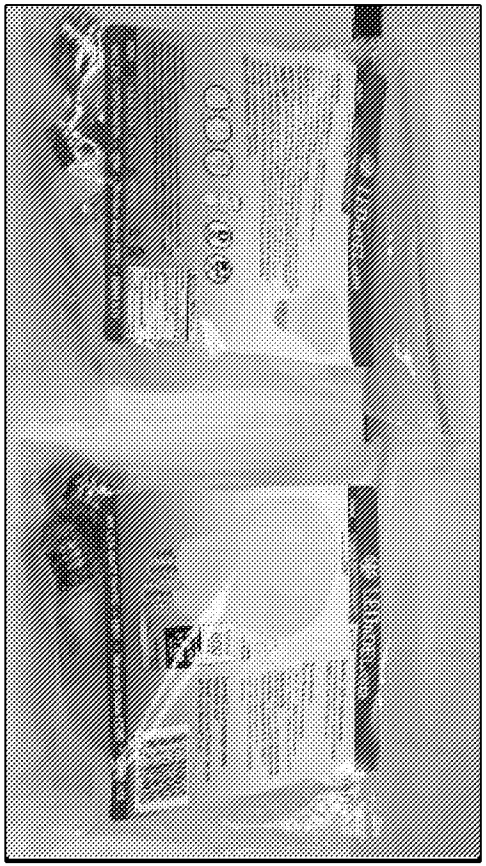
FIG. 3 is a representation of a front and back of a bag containing multiple bulbs, wherein the bag is labeled for sale according to an example embodiment.

Using bags as illustrated in FIG. 3 may have similar savings in space resulting in shipping economic savings, the above is just one example, using the most common of bulbs the A-19 bulb. One or more bulbs may be placed loosely in a bag, such as a biodegradable bag from Cortec corporation, with minimal air left in the bag. The bag may be 1-2 mm thick in some embodiments. Similar benefits may be obtained using high voltage LED lightbulbs of sizes different than A-19, such as A-17 bulbs or A-21 bulbs. The bags may have holes suitable for holding the bags on a display for purchase by consumers. One or more holes may also server a dual purpose of letting air out of the bags to reduce the overall volume of the bags. The bags with bulbs may than be added to boxes without significantly adversely affecting the number of bulbs that the boxes may hold as compared to loose bulbs packaged in the boxes.

In some embodiments, the boxes may be sized to be suitable for consumer based display in retail stores. The boxes may also be labeled to facilitate such a display by indicating the watt equivalent value of the bulbs and/or the lumens generated by the bulbs. The size of the box may vary depending on the type of display desired by the retail stores, such as floor standing boxes or boxes that may sit on a stand. The space available for display and the projected volume of sales may also be a factor in determining an optimal size of the box. Larger boxes that can hold 100 or more bulbs efficiently may be desired for high projected volume sales, while boxes holding 20 or so bulbs may be sufficient for lower projected volumes.

Figure 1A:
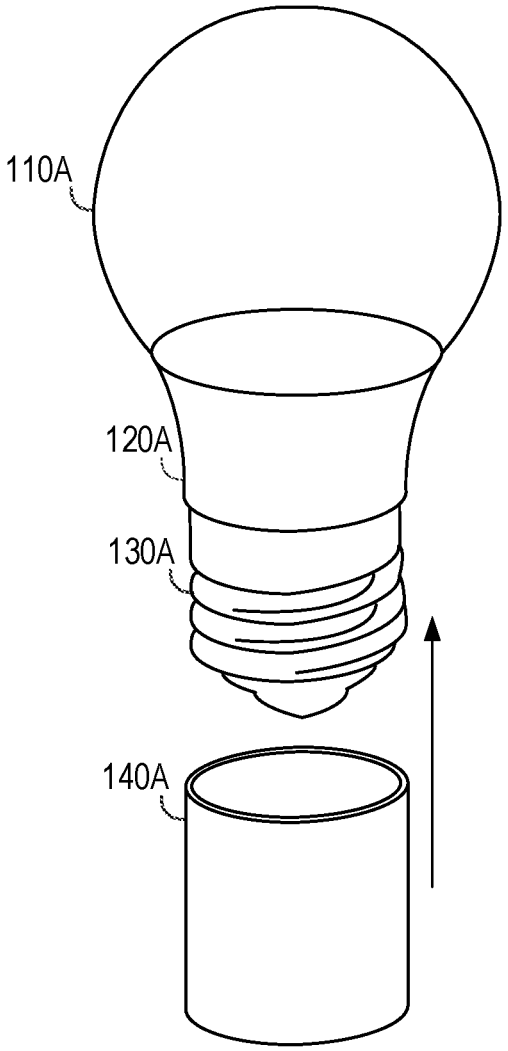
FIG. 1A is an exploded perspective view of an LED light bulb having a dome coupled to base and Edison style connector with a protective sleeve according to an example embodiment.
Figure 1B:
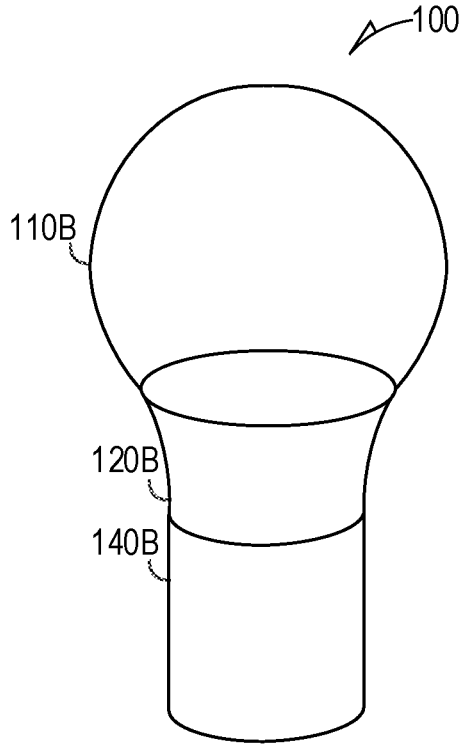
FIG. 1B is a perspective view of the LED light bulb of FIG. 1A according to an example embodiment.

FIG. 1A is an exploded perspective view of an LED light bulb 100 having a dome 110A coupled to base 120A and Edison style connector 130A. In one embodiment, a sleeve 140A is formed in a cylinder to fit over connector 130A to protect other bulbs from being marked by the connector 130A when packaged together, such as in a bag, or loosely in a box or container. The sleeve 130A may be formed of a polymer or other material, such as a paper based material, that can form a friction fit with the connector 130A when assembled together as shown in FIG. 1B. A material that shrinks when exposed to heat may also be used for the sleeve in some embodiments. Heat may be applied when the sleeve is applied to the connector to shrink the sleeve into retentive contact with the connector.

The sleeve 130A may be flexible in order to assemble it on the connector 130A. The sleeve may have a thickness sufficient to ensure it remains on the connector until removed by a consumer purchasing the bulb. The thickness in some embodiments may vary between 1 and 10 millimeters, or may be thicker in further embodiments. The thickness may be limited in various embodiments such that it does not adversely affect the volume taken up by individual bulbs when packaged together, thus facilitating compact storage and reducing shipping volume for shipments of multiple bulbs.

As shown in FIG. 1B, which is a perspective view of bulb 100, like components are numbered the same with a "B". Thus, sleeve 140B, base 12013 and dome 110B are shown with the sleeve 140B assembled over the connector, which is not visible and is shielded from contacting other bulbs when packaged loosely. A consumer, after purchasing such a bulb, may simply cut the sleeve to remove it, or may twist it off the connector, using the threads of the connector to facilitate removal.

Figure 1C:
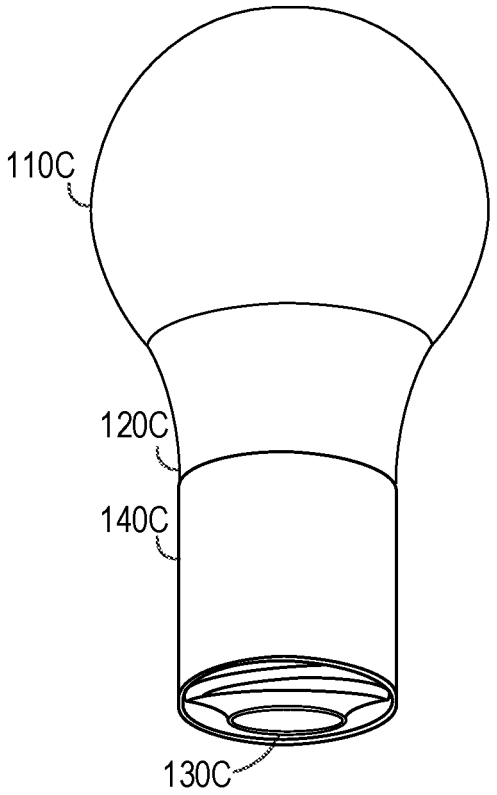
FIG. 1C is a perspective view of the LED light bulb of FIG. 1A showing a bottom of the connector, which in one embodiment is flush with, or slightly recessed within an end of the sleeve according to an example embodiment.

FIG. 1C is a perspective view of bulb 100 showing a bottom of the connector 130C, which in one embodiment is flush with, or slightly recessed within an end of the sleeve 140C. The dome is labelled as 110C and base as 120C. Note that the sleeve is open FIG. 1C.

In some embodiments, the sleeve may be preprinted with information to facilitate informing a purchaser about the bulb, and may also include a bar code or QR code to facilitate tracking by a merchant. The sleeve may alternatively have a label applied thereto by glue or other means of attachment.

Figure 2A:
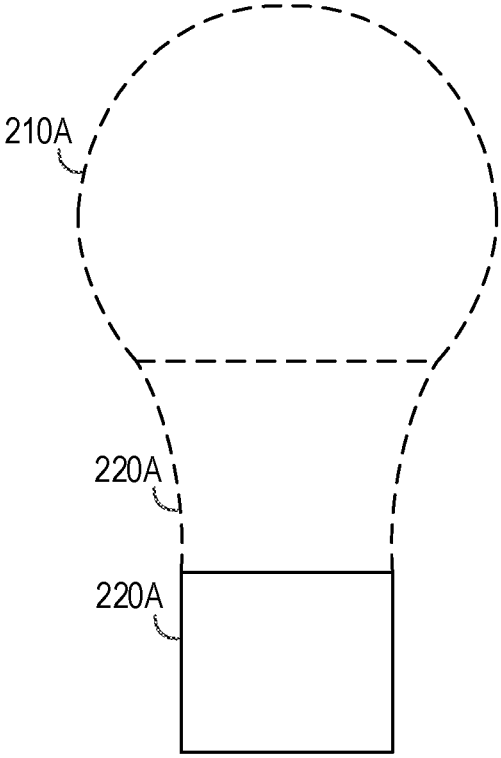
FIG. 2A is a side elevational view of an LED bulb illustrating a dome and base in broken line form, along with a protective sleeve according to an example embodiment.

FIG. 2A is a side elevational view of an LED bulb 200 illustrating a dome 210A and base 220A in broken line form, along with the sleeve 240A. The side elevational view of FIG. 2A in one embodiment is identical on all side views.

Figure 2B:
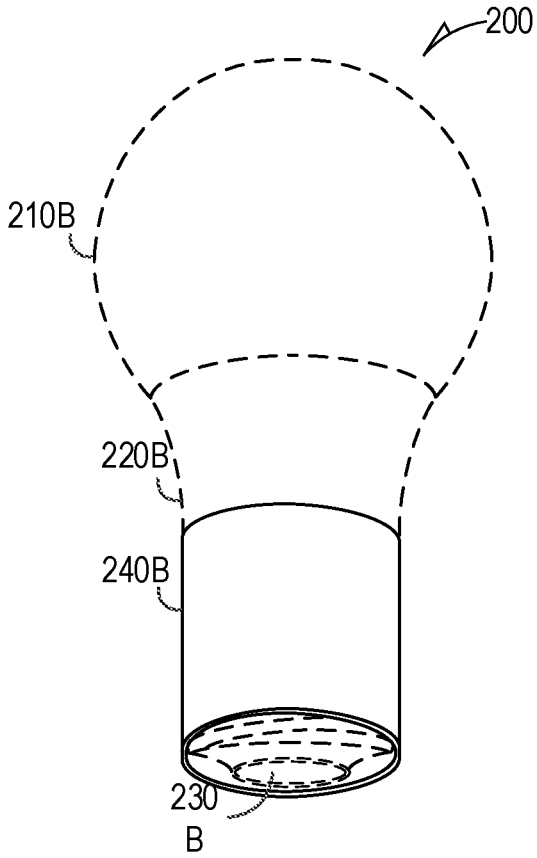
FIG. 2B is a perspective view of the LED light bulb showing the dome, base, and connector in broken line form, along with a protective sleeve, according to an example embodiment.

FIG. 2B is a perspective view of bulb 200 showing the dome 210A, base 220B, and connector 230B in broken line form. Sleeve 240B has a bottom that is shown flush with a bottom of connector 230B in this view.

Figure 2C:
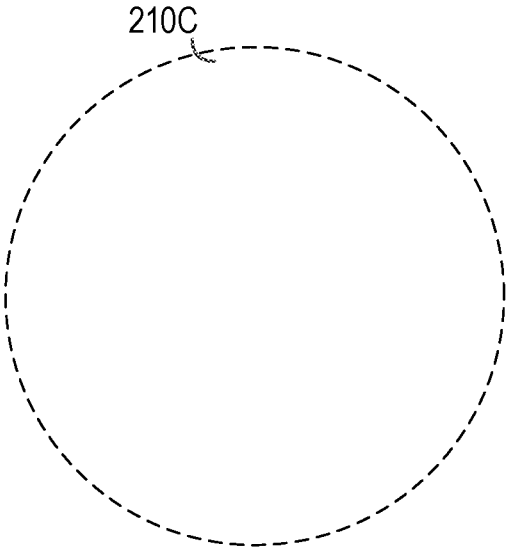
FIG. 2C is a top view of the LED light bulb according to an example embodiment.

FIG. 2C is a top view of the bulb 200 with the bulb 210C shown in broken line form. The sleeve is not visible in this view.

Figure 2D:
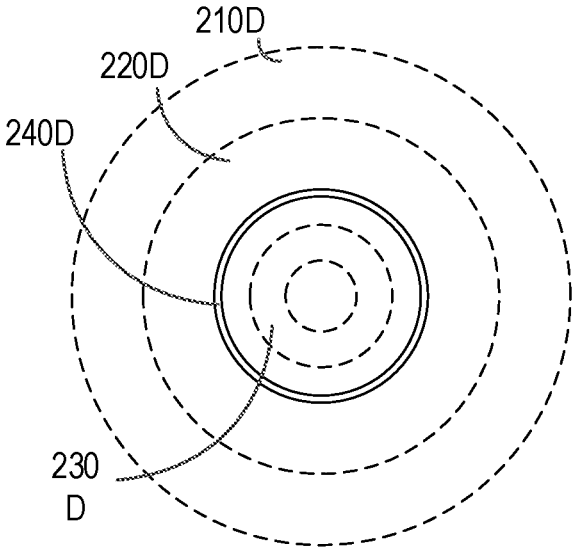
FIG. 2D is a bottom view of the light bulb according to an example embodiment.

FIG. 2D is a bottom view of the bulb 200 with the dome 210D, base 220D, and connector 240D shown in broken line form. The sleeve is indicated at 230D.

Figure 3A:
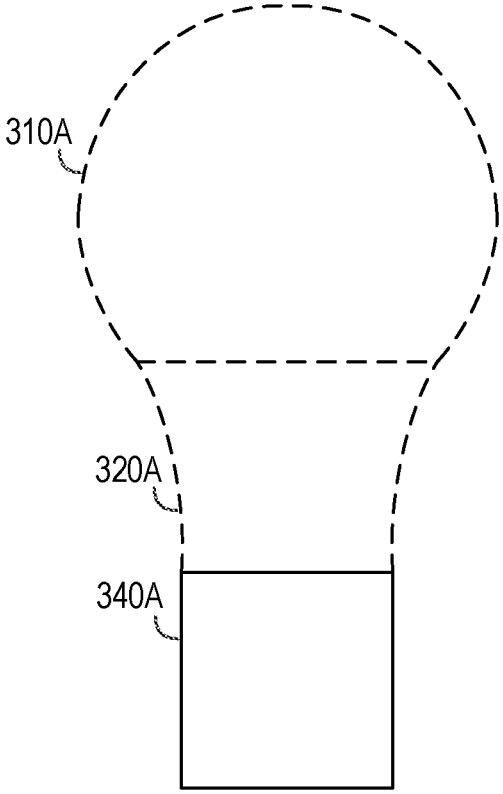
FIG. 3A is a side view of an alternative LED light bulb with a longer sleeve according to an example embodiment.
Figure 3B:
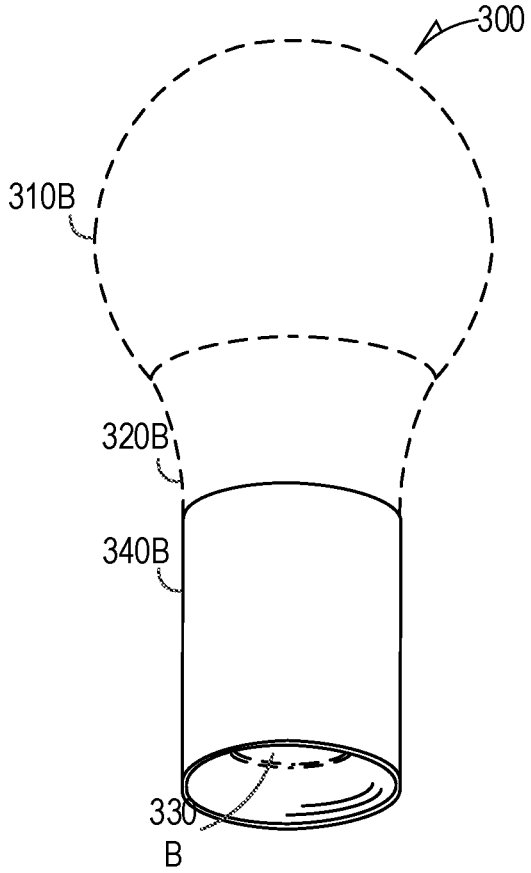
FIG. 3C is a top view of the alternative LED light bulb according to an example embodiment.
FIG. 3D is a bottom view of the alternative LED light bulb according to an example embodiment.

FIG. 3A is a side view of an alternative bulb 300 shown with a dome 310A and base 320A shown in broken line form. A sleeve 340A is also shown attached to the connector, which is not visible in this view. In one embodiment, the sleeve 340A in this embodiment extends beyond the connector, as seen more clearly in FIG. 3B, where the dome 310B, base 320B, and connector 330B are illustrated in broken line form.

Figure 3C:
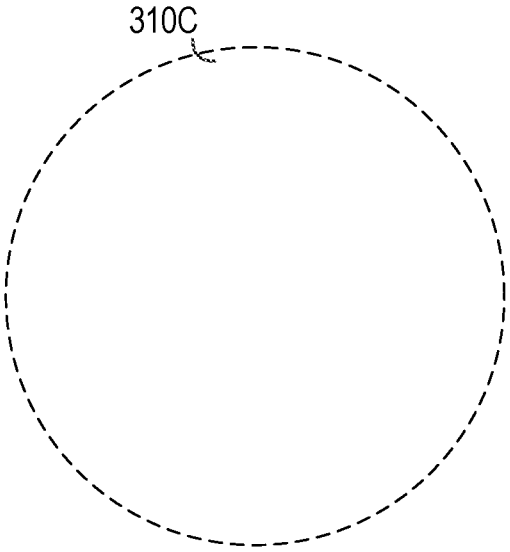

FIG. 3C is a top view of the bulb 300, where only the dome 310C is visible and is shown in broken line form.

Figure 3D:
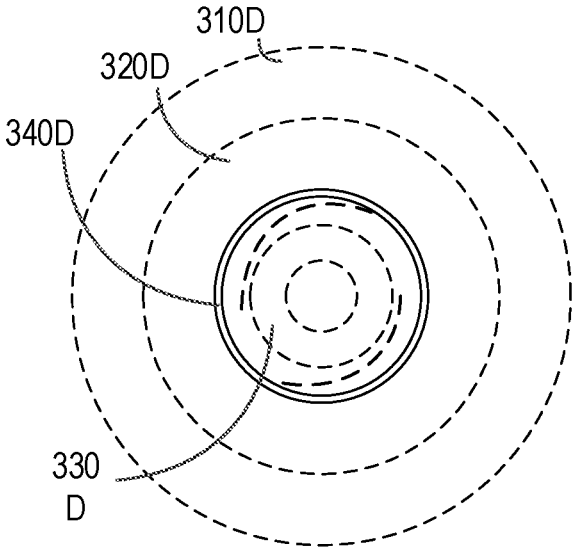

FIG. 3D is a bottom view of the bulb 300 with the dome 310D, base 320D, and connector 330D shown in broken line form. The sleeve is indicated at 340D.

Figure 4A:
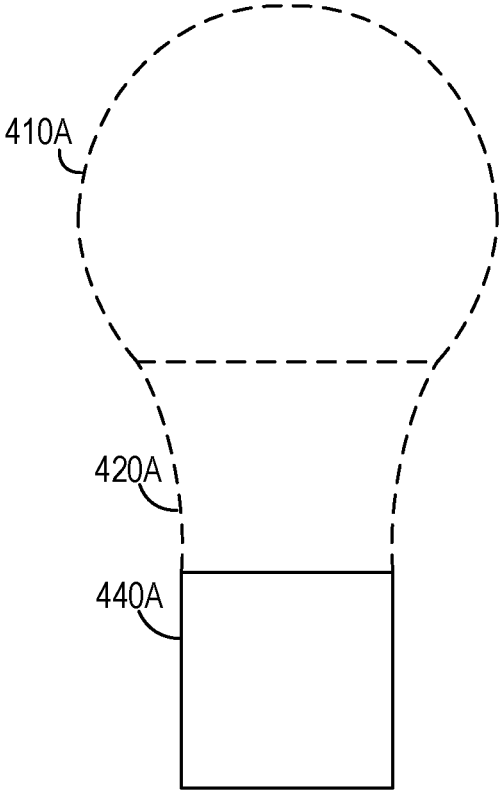
FIG. 4A is a side view of an alternative LED light bulb according to an example embodiment.
Figure 4B:
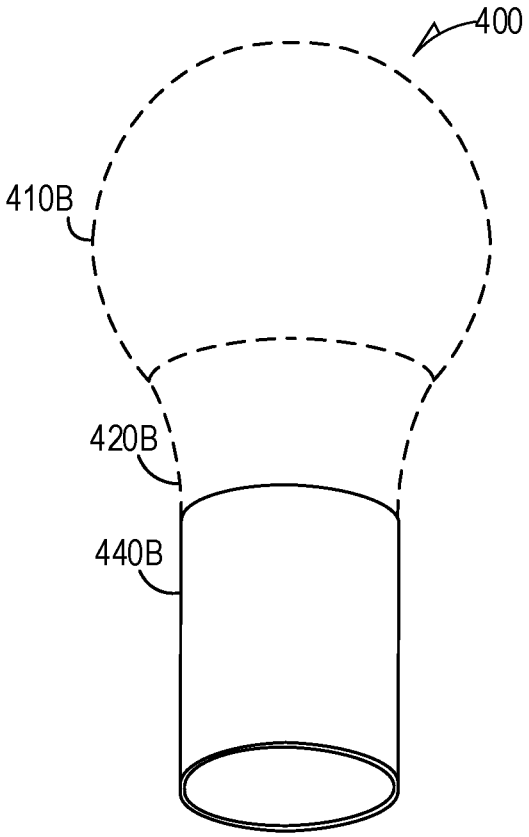
FIG. 4B is a side perspective view of the alternative LED light bulb according to an example embodiment.

FIG. 4A is a side view of an alternative bulb 400 shown with a dome 410A and base 420A shown in broken line form. A sleeve 440A is also shown attached to the connector, which is not visible in this view. In one embodiment, the sleeve 440A in this embodiment extends well beyond the connector, as seen more clearly in FIG. 4B, where the dome 410B and base 420B are illustrated in broken line form, and the connector is not even visible due to the sleeve extending further than in previous embodiments. The extension of the sleeve beyond the connector can ensure that the connector will not mark other bobs when bulbs are loosely packed together.

Figure 4C:
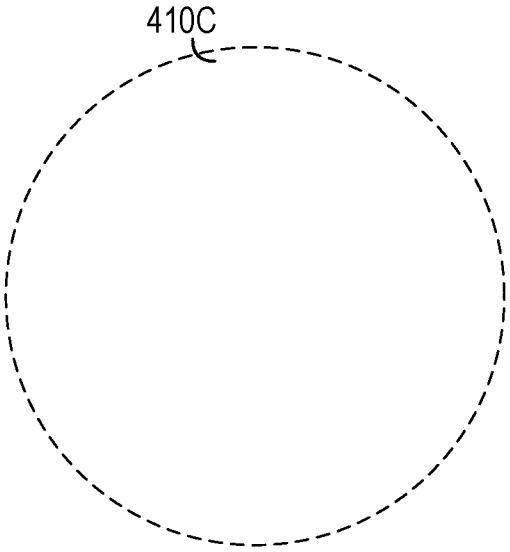
FIG. 4C is a top view of the alternative LED light bulb according to an example embodiment.

FIG. 4C is a top view of the bulb 400, where only the dome 410C is visible and is shown in broken line form.

Figure 4D:
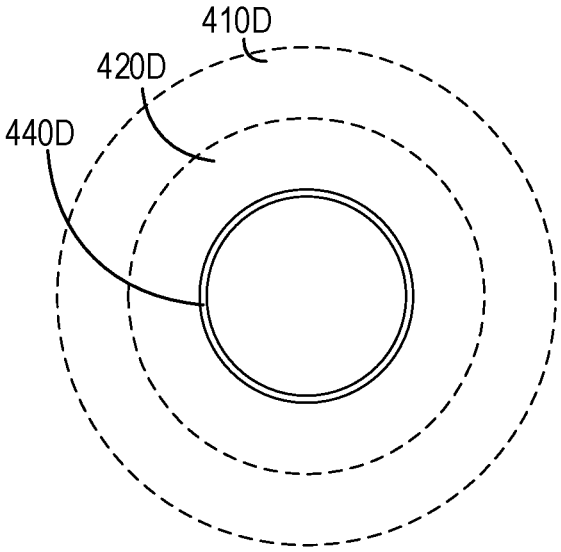
FIG. 4D is a bottom view of the alternative LED light bulb according to an example embodiment.

FIG. 4D is a bottom view of the bulb 400 with the dome 410D, base 420D, and connector 430D shown in broken line form. The sleeve is indicated at 440D.

Figure 5:
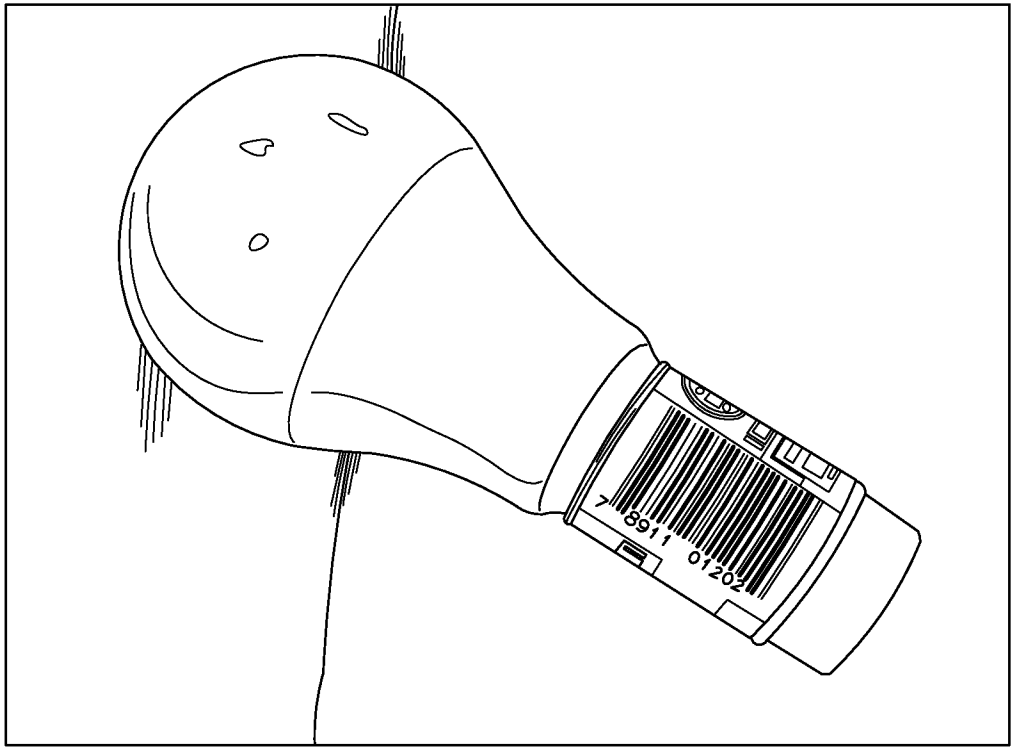
FIG. 5 is a photograph of an LED light bulb with a sleeve containing printed material according to an example embodiment.

FIG. 5 is a photograph of an LED light bulb with a sleeve containing printed material according to an example embodiment. The printed material may include a barcode and other information material describing the origin of the bulb and specifications of the bulb, such as number of lumens, wattage, type of light—soft white, identifying the bulb as an LED light bulb, etc.

Figure 6:
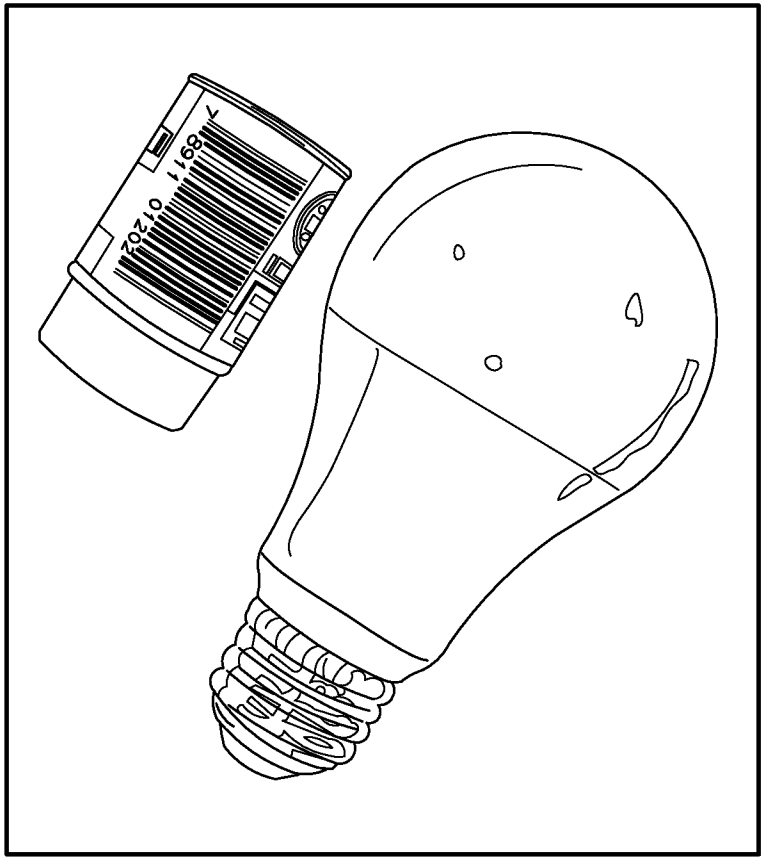
FIG. 6 is a photograph of an LED light bulb with a sleeve separated from the connector according to an example embodiment.

FIG. 6 is a photograph of an LED light bulb with a sleeve separated from the connector according to an example embodiment.

Figure 7:
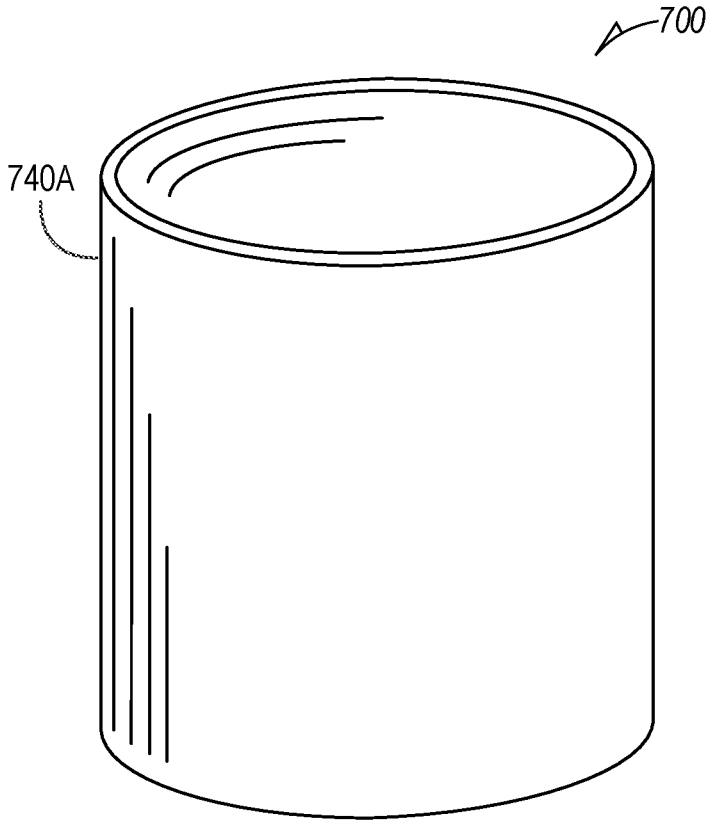
FIG. 7 is a perspective elevational view of a sleeve for fitting over a light bulb connector according to an example embodiment.

FIG. 7 is a perspective elevational view of a sleeve 740 for fitting over a light bulb connector according to an example embodiment. In various embodiments, the sleeve may be as long as the connector to protect other bulbs from being marked by the connector, or may be longer to provide additional protection. The length may selected as a balance between packing density of the bulbs and probability of the connector of one bulb marking other bulbs through motion while shipping the bulbs to customer or retail destinations. In some embodiments, the sleeve may include a bottom such that the connector is not visible or accessible to mark other bulbs. The bottom may be made of the same material or a different material, but should be non-harmful to other bulbs when packaged together loosely.

In some embodiments, the sleeve may have a slightly ribbed structure to form a better friction fit with the connector such that it stays in place during transit and during retail display of the bulbs. The ribs may also help ensure that the sleeves are not stretched to the point that they split and fall off the connector. The ribs may not be visible to a purchaser during normal use of the sleeves while covering the connectors.

Figure 8A:
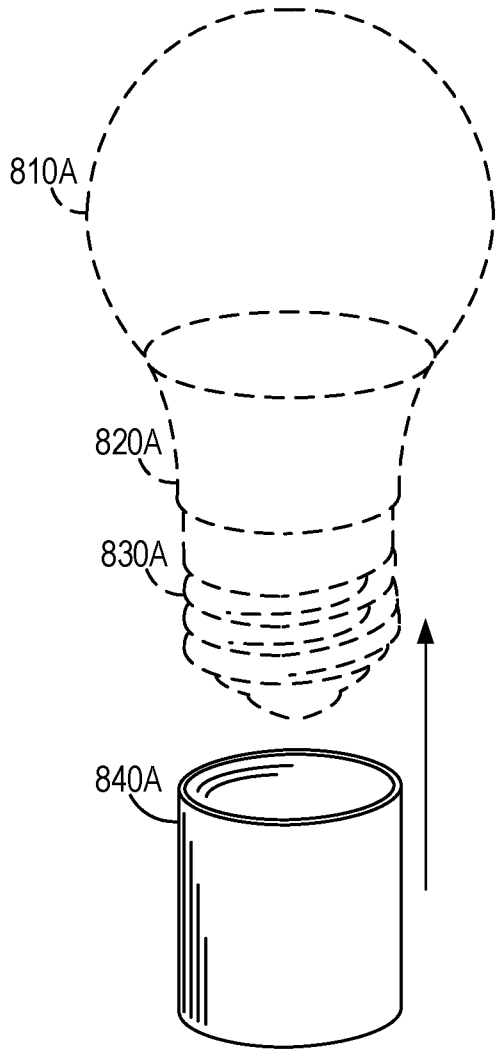
FIG. 8A is an exploded perspective view of an LED light bulb having a dome coupled to base and Edison style connector with a protective sleeve according to an example embodiment.

FIG. 8A is an exploded perspective view of an LED light bulb 200 having a dome 810A coupled to base 820A and Edison style connector 830A with a protective sleeve 840A according to an example embodiment.

Figure 8B:
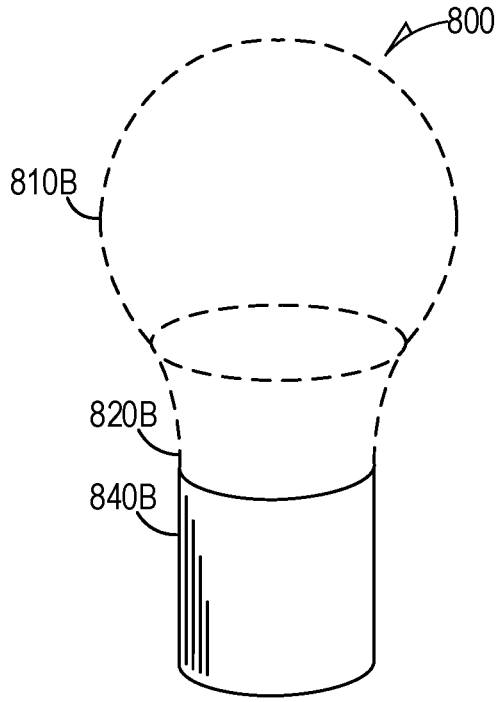
FIG. 8B is a perspective view of the LED light bulb of FIG. 8A according to an example embodiment.

FIG. 8B is a perspective view of the LED light bulb 200 of FIG. 8A according to an example embodiment with dome 810B, base 820B, and sleeve 840B.

Figure 8C:
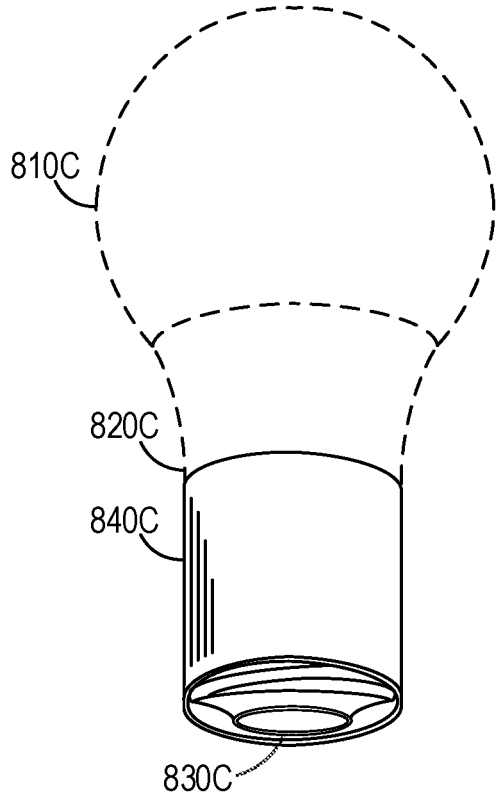
FIG. 8C is a perspective view of the LED light bulb of FIG. 1A showing a bottom of the connector, which in one embodiment is flush with, or slightly recessed within an end of the sleeve according to an example embodiment.

FIG. 8C is a perspective view of the LED light bulb of FIG. 1A showing a bottom of the connector 830C, which in one embodiment is flush with, or slightly recessed within an end of the sleeve 840C according to an example embodiment. Also shown are the dome 810C and base 820C.

Figure 9A:
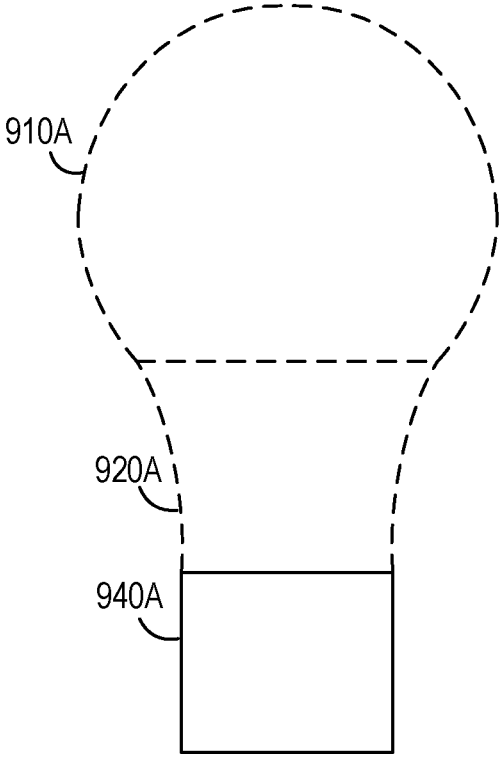
FIG. 9A is a side elevational view of a lightbulb with sleeve according to an example embodiment.

FIG. 9A is a side elevational view of a lightbulb 900 with dome 910A, base 920A, and sleeve 940B.

Figure 9B:
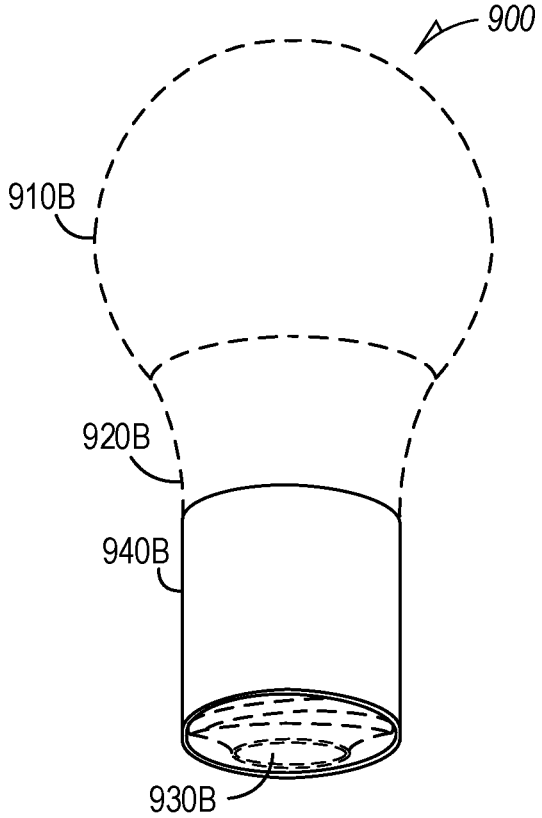
FIG. 9B is a perspective view of the lightbulb of FIG. 9A showing a bottom with a connector visible according to an example embodiment.

FIG. 9B is a perspective view of the lightbulb of FIG. 9A showing a dome 910B, base 920B, and sleeve 940B bottom with a connector 930B visible according to an example embodiment.

Figure 9C:
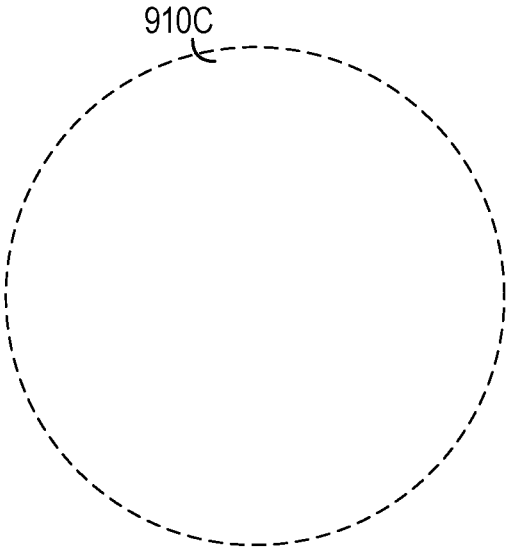
FIG. 9C is a top view of the lightbulb of FIG. 9A according to an example embodiment.

FIG. 9C is a top view of the lightbulb of FIG. 9A according to an example embodiment showing dome 910C.

Figure 9D:
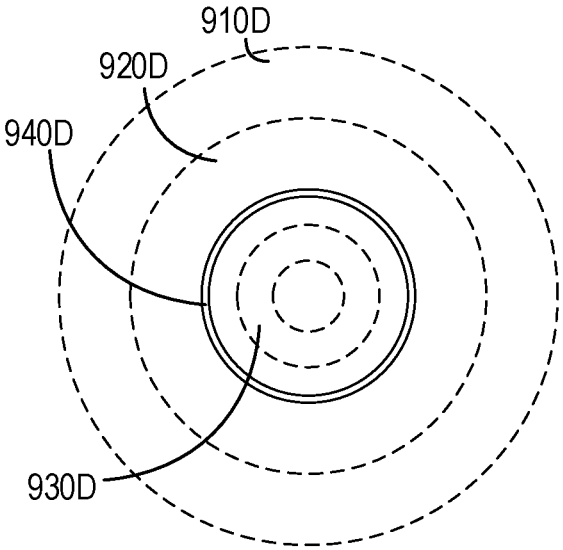
FIG. 9D is a bottom view of the lightbulb of FIG. 9A according to an example embodiment.

FIG. 9D is a bottom view of the lightbulb of FIG. 9A according to an example embodiment showing dome 910D, base 920D, connector 930D and sleeve 940D.

Figure 10A:
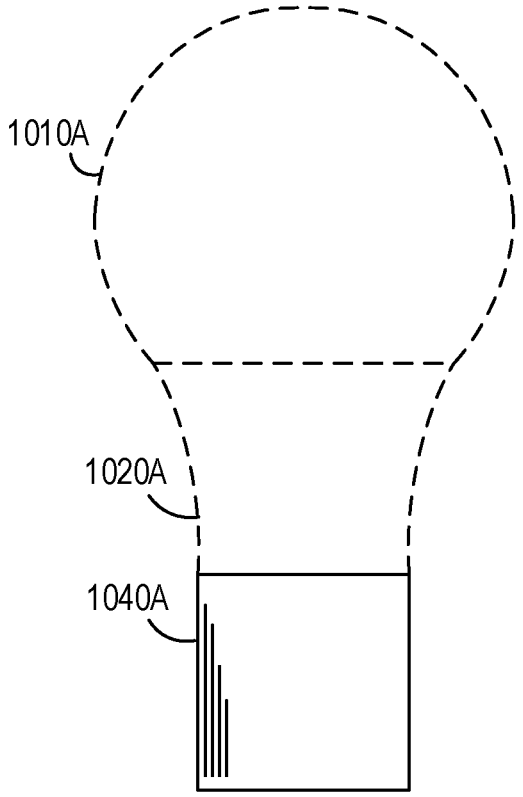
FIG. 10A is a side elevational view of a lightbulb with longer sleeve according to an example embodiment.

FIG. 10A is a side elevational view of a lightbulb 1000 with longer sleeve 1040A according to an example embodiment. Also shown are dome 1010A, and base 1020A.

Figure 10B:
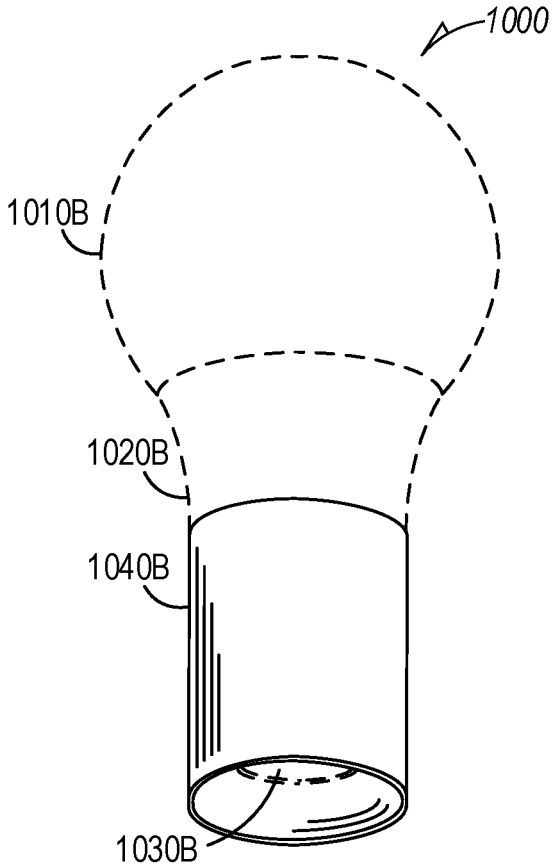
FIG. 10B is a perspective view of the lightbulb of FIG. 10A showing a bottom with a connector visible according to an example embodiment.

FIG. 10B is a perspective view of the lightbulb of FIG. 10A showing a bottom with a connector 1030E visible according to an example embodiment. Also shown are dome 1010B, base 1020B, and sleeve 1040B.

Figure 10C:
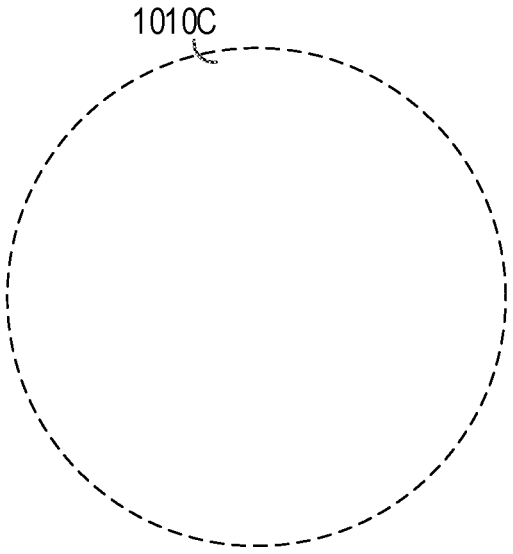
FIG. 10C is a top view of the lightbulb of FIG. 10A according to an example embodiment.

FIG. 10C is a top view of the lightbulb of FIG. 10A according to an example embodiment showing dome 1010C.

Figure 10D:
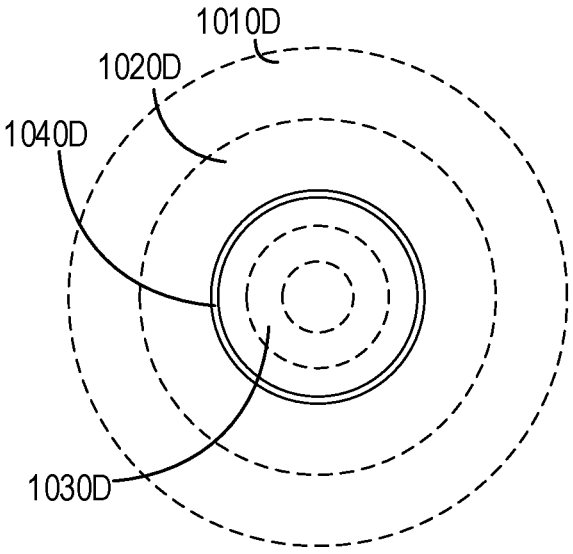
FIG. 10D is a bottom view of the lightbulb of FIG. 10A according to an example embodiment.

FIG. 10D is a bottom view of the lightbulb of FIG. 10A according to an example embodiment. The dome 1010D, base 1020D and connector 1030D are represented in broken lines and do not form a part of the design in these figures. The sleeve 1040D is shown in solid line form and does for part of the design.

Figure 11A:
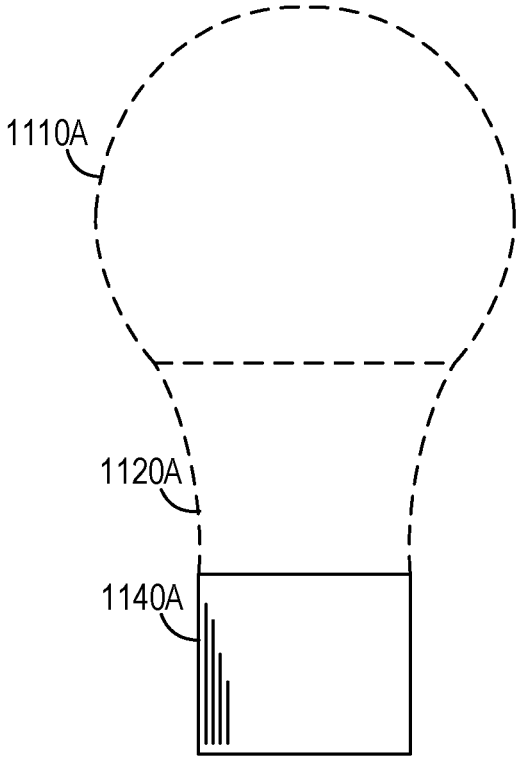
FIG. 11A is a side elevational view of a lightbulb with sleeve having a bottom according to an example embodiment.

FIG. 11A is a side elevational view of a lightbulb 1100 with sleeve 1140A having a bottom according to an example embodiment. Lightbulb 1100 is also shown with dome 1110A and base 1120A.

Figure 11B:
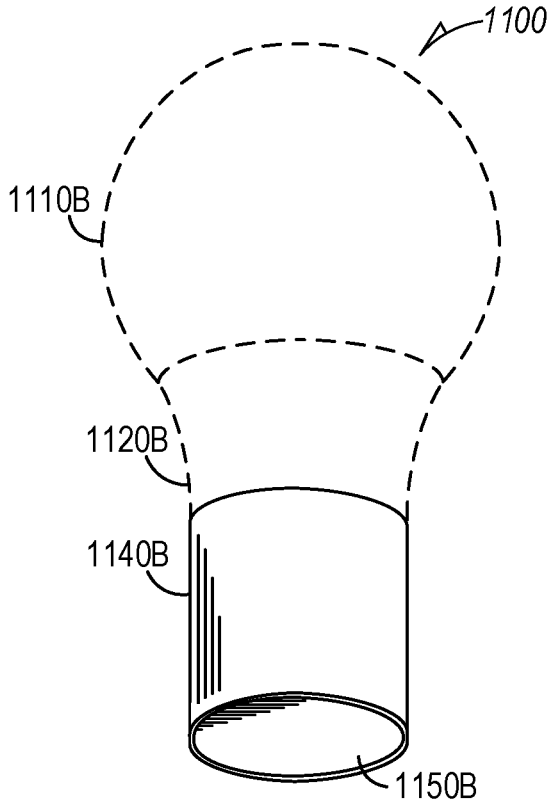
FIG. 11B is a perspective view of the lightbulb of FIG. 11A showing the bottom covering the connector according to an example embodiment.

FIG. 11B is a perspective view of the lightbulb of FIG. 11A showing the bottom 1150B covering the connector according to an example embodiment. Also shown are dome 1110B, base 1120B and sleeve 1140B.

Figure 11C:
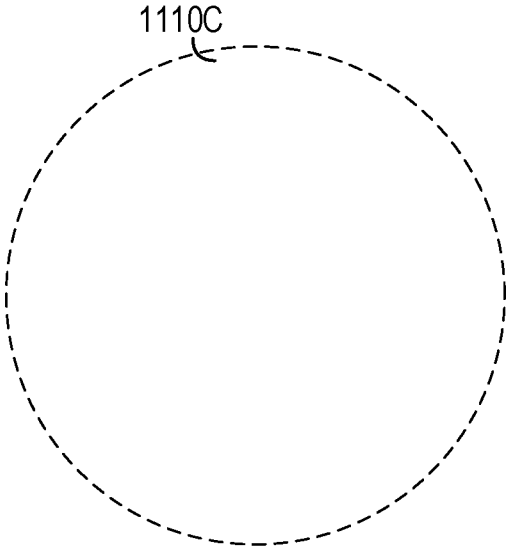
FIG. 11C is a top view of the lightbulb of FIG. 11A according to an example embodiment.

FIG. 11C is a top view of the lightbulb of FIG. 11A according to an example embodiment. Dome 1110C is visible.

Figure 11D:
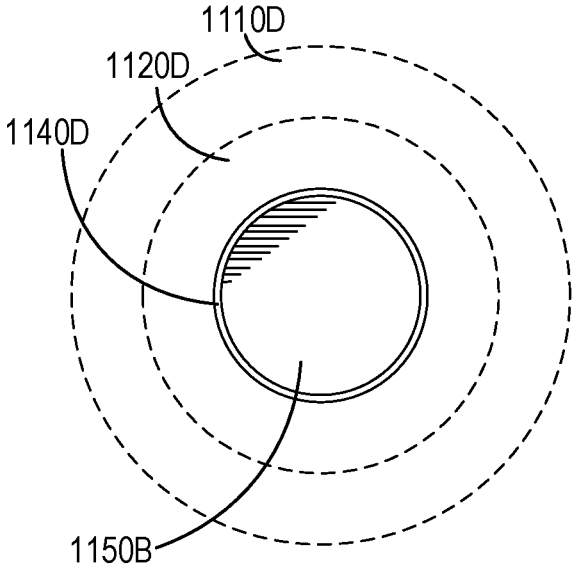
FIG. 11D is a bottom view of the lightbulb of FIG. 11A according to an example embodiment.

FIG. 11D is a bottom view of the lightbulb of FIG. 11A according to an example embodiment. Visible are bottom 1150D, sleeve 1140D, base 1120D and dome 1110D.

Figure 12:
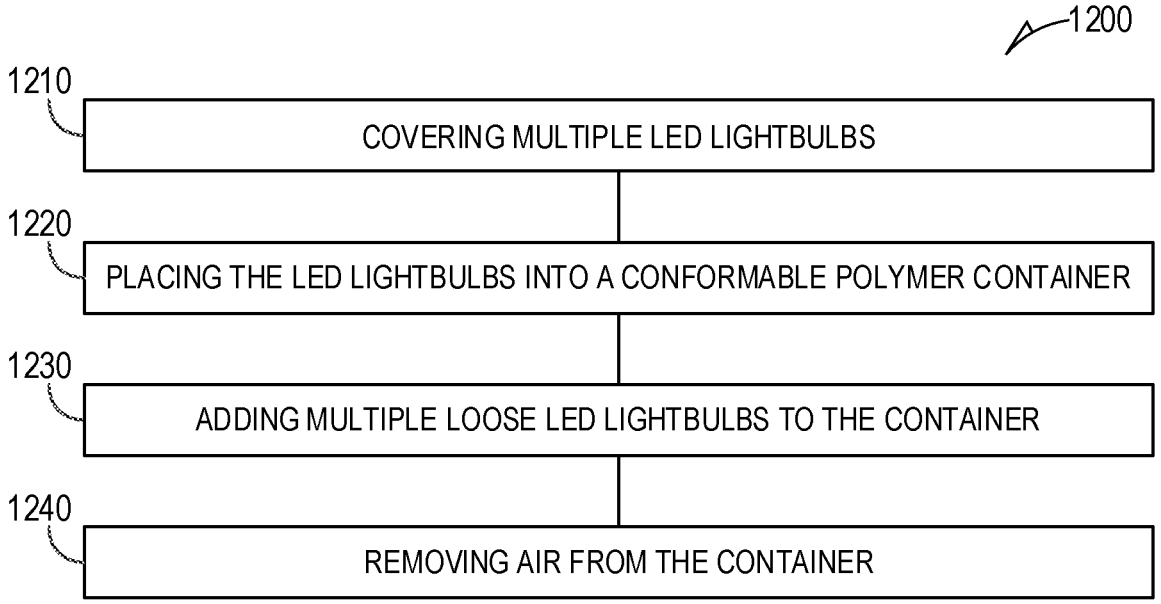
FIG. 12 is a first LED light bulb packaging method according to an embodiment.

FIG. 12 is a first LED light bulb packaging method 1200 according to an embodiment. Method 1200 may include covering 1210 multiple light emitting diode (LED) lightbulbs having Edison connectors with a protective sleeve that extends at least to an end of each connector. Method 1200 may include placing 1220 the connector covered multiple light emitting diode (LED) lightbulbs into a conformable polymer container having a hole. Method 1200 may include adding 1230 multiple loose LED lightbulbs to the container to fill the container. Method 1200 may include removing 1240 air from the container via the hole such that the loose LED lightbulbs nest with each other in direct contact with each other such that the container contains a higher density of LED light bulbs than a same sized container can hold protective packaged equivalent watt incandescent bulbs. The conformable polymer container may include a plastic bag and wherein the number of LED lightbulbs placed in the plastic bag is at least two. The hole may be placed proximate a periphery of the container such that the container is positionable on a post for display in a retail store.

Figure 13:
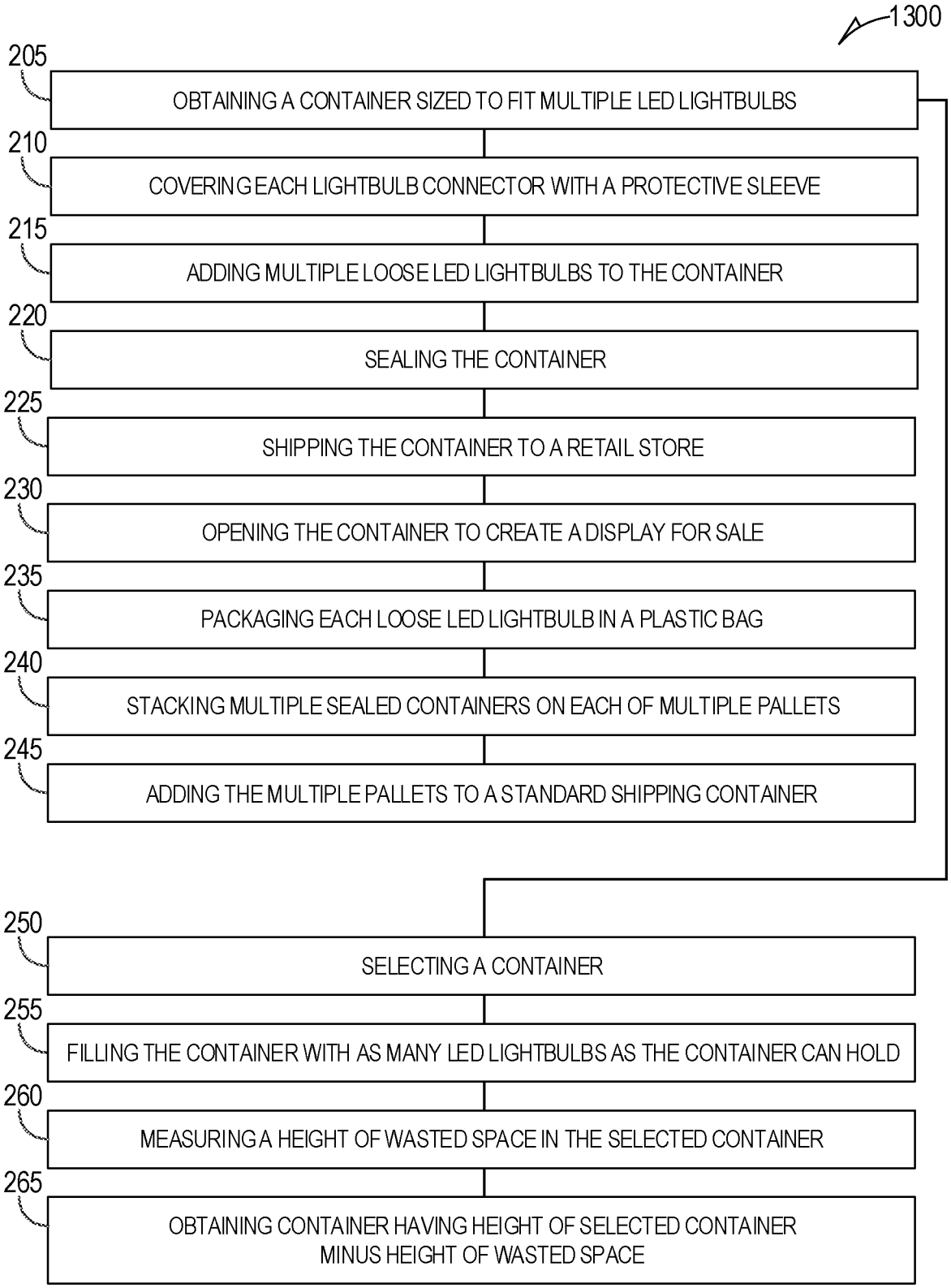
FIG. 13 is a second LED light bulb packaging method according to an embodiment.

FIG. 13 is a second LED light bulb packaging method 1300 according to an embodiment. Method 1300 may include obtaining 1305 a container sized to fit multiple light emitting diode (LED) lightbulbs having Edison connectors. Method 1300 may include covering 1310 each lightbulb connector with a protective sleeve that extends at least to an end of each connector. Method 1300 may include adding 1315 multiple loose LED lightbulbs to the container to fill the container with the loose LED lightbulbs nesting with each other. Method 1300 may include sealing 1320 the container, such that the container contains a higher density of LED light bulbs than a same sized container can hold protective packaged equivalent watt incandescent bulbs.

Method 1300 may include shipping 1325 the container to a retail store. Method 1300 may include opening 1330 the container to create a display for sale of the LED lightbulbs directly from the opened container. Method 1300 may include packaging 1335 each loose LED lightbulb in a plastic bag without significant air in the bag prior to adding the multiple loose LED lightbulbs to the container. Each bag may contain multiple LED lightbulbs. The container may include a plastic bag.

Method 1300 may include stacking 1340 multiple sealed containers on each of multiple pallets. Method 1300 may include adding 1345 the multiple pallets to a standard shipping container. The LED lightbulbs may conform in shape to an A19 sized bulb, each container may contain at least 256 LED lightbulbs, each pallet may hold 32 containers, and the standard shipping container may hold 22 pallets for a total of at least 180,224 LED lightbulbs. The LED lightbulbs may have plastic domes that resist damage when loosely packaged.

In obtaining 1305 a container sized to fit multiple light emitting diode (LED) lightbulbs, method 1300 may further include selecting 1350 a container, filling 1355 the container with as many LED lightbulbs as the container can hold and still be closed, measuring 1360 a height of wasted space in the selected container, and obtaining 1365 a container having a height of the selected container minus the height of the wasted space.

Although a few embodiments have been described in detail above, other modifications are possible. For example other components may be added to, or removed from, the described embodiments. Other embodiments may be within the scope of the following claims.

The following statements are potential claims that may be converted to claims in a future application. No modification of the following statements should be allowed to affect the interpretation of claims which may be drafted when this provisional application is converted into a regular utility application.

The invention claimed is:

1. A method comprising:

covering multiple high lumen light emitting diode (LED) lightbulbs having Edison connectors with a protective sleeve that extends at least to an end of each connector;

placing the connector covered multiple high lumen LED lightbulbs into a conformable polymer container having a hole;

adding multiple loose high lumen LED lightbulbs in direct contact with each other to the container to fill the container; and removing air from the container via the hole such that the loose high lumen LED lightbulbs nest with each other in a non-repeating arrangement in direct contact with each other such that the container contains a higher density of high lumen LED light bulbs per unit volume of the container than could be contained in a same sized container using protective-packaged equivalent-lumen incandescent bulbs in a repeating parallel arrangement.

2. The method of claim 1 wherein the conformable polymer container comprises a plastic bag and wherein the number of high lumen LED lightbulbs placed in the plastic bag is at least two.

3. The method of claim 1 wherein the hole is placed proximate a periphery of the container such that the container is positionable on a post for display in a retail store.

4. A method comprising:

obtaining a container sized to fit multiple loose high voltage light emitting diode (LED) lightbulbs having Edison connectors;

covering each lightbulb connector with a protective sleeve that extends at least to an end of each connector;

adding multiple loose high voltage LED lightbulbs to the container to fill the container with the loose high voltage LED lightbulbs nesting with each other in a non-repeating arrangement and in direct contact with each other; and sealing the container, such that the container contains a higher density of high voltage LED light bulbs per unit volume of the container than could be contained in a same sized container using protective-packaged equivalent-watt incandescent bulbs in a repeating parallel arrangement.

5. The method of claim 4 and further comprising:

shipping the container to a retail store; and opening the container to create a display for sale of the high voltage LED lightbulbs directly from the opened container.

6. The method of claim 4 and further comprising packaging each loose high voltage LED lightbulb in a plastic bag with a reduced amount of air in the bag prior to adding the multiple loose high voltage LED lightbulbs to the container.

7. The method of claim 6 wherein each bag contains multiple high voltage LED lightbulbs.

8. The method of claim 4 wherein the container comprises a plastic bag.

9. The method of claim 4 and further comprising:

stacking a plurality of sealed containers on each of a plurality of pallets, each of the plurality of sealed containers prepared using the method of claim 4; and adding the plurality of pallets to a standard shipping container.

10. The method of claim 9 wherein the high voltage LED lightbulbs conform in shape to an A19 sized bulb and wherein each standard shipping container contains at least 256 high voltage LED lightbulbs, each pallet holds 32 containers, and the standard shipping container holds 22 pallets for a total of at least 180,224 high voltage LED lightbulbs.

11. The method of claim 4 wherein the high voltage LED lightbulbs have plastic domes that resist damage when loosely packaged.

12. The method of claim 4 wherein obtaining a container sized to fit multiple high voltage LED lightbulbs comprises:

selecting a test container;

filling the test container with as many high voltage LED lightbulbs as the test container can hold and still be closed;

measuring a height of unused volume in the selected test container; and obtaining a target container having a height of the selected test container minus the height of the unused volume.

* * * * *